US009410422B2

(12) United States Patent
Sondhi

(10) Patent No.: US 9,410,422 B2
(45) Date of Patent: Aug. 9, 2016

(54) ALTERNATIVE GAUGING SYSTEM FOR PRODUCTION WELL TESTING AND RELATED METHODS

(71) Applicant: Chevron U.S.A. Inc., San Ramon, CA (US)

(72) Inventor: Amit Sondhi, Bakersfield, CA (US)

(73) Assignee: CHEVRON U.S.A. INC., San Ramon, CA (US)

( * ) Notice: Subject to any disclaimer, the term of this patent is extended or adjusted under 35 U.S.C. 154(b) by 252 days.

(21) Appl. No.: 14/026,941

(22) Filed: Sep. 13, 2013

(65) Prior Publication Data

US 2015/0075273 A1 Mar. 19, 2015

(51) Int. Cl.
*E21B 49/08* (2006.01)
*E21B 49/00* (2006.01)

(52) U.S. Cl.
CPC ..... *E21B 49/008* (2013.01)

(58) Field of Classification Search
CPC ..... E21B 49/008
USPC ..... 73/152.29; 166/75.12, 250.01
See application file for complete search history.

(56) References Cited

U.S. PATENT DOCUMENTS

| | | | |
|---|---|---|---|
| 3,149,492 | A | 9/1964 | Weinberg |
| 3,851,521 | A | 12/1974 | Ottenstein |
| 4,080,837 | A | 3/1978 | Alexander |
| 4,114,439 | A | 9/1978 | Fick |
| 4,144,768 | A | 3/1979 | Andersson |
| 4,159,646 | A | 7/1979 | Paulsen |
| 4,164,865 | A | 8/1979 | Hall |
| 4,236,406 | A | 12/1980 | Reed |
| 4,275,602 | A | 6/1981 | Fujishiro |
| 4,445,389 | A | 5/1984 | Potzick |
| 4,499,418 | A | 2/1985 | Helms |
| 4,515,473 | A | 5/1985 | Mermelstein |
| 4,520,320 | A | 5/1985 | Potzick |
| 4,546,649 | A | 10/1985 | Kantor |
| 4,706,501 | A | 11/1987 | Atkinson |
| 4,788,852 | A | 12/1988 | Martin |
| 4,813,270 | A | 3/1989 | Baillie |
| 4,862,750 | A | 9/1989 | Nice |
| 4,864,868 | A | 9/1989 | Khalifa |
| 4,884,457 | A | 12/1989 | Hatton |
| 4,896,540 | A | 1/1990 | Shakkottai |
| 4,932,262 | A | 6/1990 | Wlodarczyk |
| 4,947,127 | A | 8/1990 | Helms |
| 4,950,883 | A | 8/1990 | Glenn |
| 4,976,151 | A | 12/1990 | Morishita |
| 4,996,419 | A | 2/1991 | Morey |
| 5,024,099 | A | 6/1991 | Lee |
| 5,031,460 | A | 7/1991 | Kanenobu |

(Continued)

FOREIGN PATENT DOCUMENTS

| | | | |
|---|---|---|---|
| WO | 2008078996 | A1 | 7/2008 |
| WO | 2010117549 | A1 | 10/2010 |
| WO | 2010120258 | A2 | 10/2010 |

*Primary Examiner* — Peter Macchiarolo
*Assistant Examiner* — Anthony W Megna Fuentes

(57) ABSTRACT

A method for measuring a well fluid parameter includes diverting a fluid through a first loop comprising one or more fluid parameter measurement components, determining a gross flow rate of the fluid, recirculating the fluid through a second loop upon determining the gross flow rate is below a threshold amount, and measuring the fluid parameter upon the gross flow rate reaching or exceeding the threshold amount.

22 Claims, 4 Drawing Sheets

(56) References Cited

U.S. PATENT DOCUMENTS

| | | | |
|---|---|---|---|
| 5,040,415 | A | 8/1991 | Barkhoudarian |
| 5,051,922 | A | 9/1991 | Toral |
| 5,058,437 | A | 10/1991 | Chaumont |
| 5,083,452 | A | 1/1992 | Hope |
| 5,099,697 | A | 3/1992 | Agar |
| 5,115,670 | A | 5/1992 | Shen |
| 5,152,181 | A | 10/1992 | Lew |
| 5,207,107 | A | 5/1993 | Wolf |
| 5,218,197 | A | 6/1993 | Carroll |
| 5,317,576 | A | 5/1994 | Leonberger |
| 5,321,991 | A | 6/1994 | Kalotay |
| 5,347,873 | A | 9/1994 | Vander Heyden |
| 5,361,130 | A | 11/1994 | Kersey |
| 5,363,342 | A | 11/1994 | Layton |
| 5,367,911 | A | 11/1994 | Jewell |
| 5,372,046 | A | 12/1994 | Kleven |
| 5,398,542 | A | 3/1995 | Vasbinder |
| 5,401,956 | A | 3/1995 | Dunphy |
| 5,426,297 | A | 6/1995 | Dunphy |
| 5,440,932 | A | 8/1995 | Wareham |
| 5,493,390 | A | 2/1996 | Varasi |
| 5,493,512 | A | 2/1996 | Peube |
| 5,513,913 | A | 5/1996 | Ball |
| 5,564,832 | A | 10/1996 | Ball |
| 5,576,497 | A | 11/1996 | Vignos |
| 5,591,922 | A | 1/1997 | Segeral |
| 5,597,961 | A | 1/1997 | Marrelli |
| 5,639,667 | A | 6/1997 | Heslot |
| 5,642,098 | A | 6/1997 | Santa Maria |
| 5,644,093 | A | 7/1997 | Wright |
| 5,654,551 | A | 8/1997 | Watt |
| 5,670,720 | A | 9/1997 | Clark |
| 5,680,489 | A | 10/1997 | Kersey |
| 5,689,540 | A | 11/1997 | Stephenson |
| 5,708,211 | A | 1/1998 | Jepson |
| 5,730,219 | A | 3/1998 | Tubel |
| 5,732,776 | A | 3/1998 | Tubel |
| 5,741,980 | A | 4/1998 | Hill |
| 5,803,167 | A | 9/1998 | Bussear |
| 5,804,713 | A | 9/1998 | Kluth |
| 5,842,347 | A | 12/1998 | Kinder |
| 5,845,033 | A | 12/1998 | Berthold |
| 5,906,238 | A | 5/1999 | Carmody |
| 5,907,104 | A | 5/1999 | Cage |
| 5,908,990 | A | 6/1999 | Cummings |
| 5,925,821 | A | 7/1999 | Bousquet |
| 5,925,879 | A | 7/1999 | Hay |
| 5,939,643 | A | 8/1999 | Oertel |
| 5,956,132 | A | 9/1999 | Donzier |
| 5,959,547 | A | 9/1999 | Tubel |
| 5,963,880 | A | 10/1999 | Smith |
| 5,975,204 | A | 11/1999 | Tubel |
| 5,992,519 | A | 11/1999 | Ramakrishnan |
| 5,996,690 | A | 12/1999 | Shaw |
| 6,002,985 | A | 12/1999 | Stephenson |
| 6,003,383 | A | 12/1999 | Zielinska |
| 6,003,385 | A | 12/1999 | De Vanssay |
| 6,009,216 | A | 12/1999 | Pruett |
| 6,016,702 | A | 1/2000 | Maron |
| 6,106,561 | A | 8/2000 | Farmer |
| 6,158,288 | A | 12/2000 | Smith |
| 6,216,532 | B1 | 4/2001 | Stephenson |
| 6,233,374 | B1 | 5/2001 | Ogle |
| 6,279,660 | B1 | 8/2001 | Hay |
| 6,354,147 | B1 | 3/2002 | Gysling |
| 6,910,388 | B2 | 6/2005 | Jones |
| 6,916,424 | B2 | 7/2005 | Collins |
| 6,995,768 | B2 | 2/2006 | Jou |
| 7,028,538 | B2 | 4/2006 | Gysling |
| 7,032,432 | B2 | 4/2006 | Gysling |
| 7,058,549 | B2 | 6/2006 | Gysling |
| 7,062,976 | B2 | 6/2006 | Gysling |
| 7,086,278 | B2 | 8/2006 | Gysling |
| 7,093,501 | B2 | 8/2006 | Kuo |
| 7,096,719 | B2 | 8/2006 | Gysling |
| 7,109,471 | B2 | 9/2006 | Taverner |
| 7,110,893 | B2 | 9/2006 | Loose |
| 7,121,152 | B2 | 10/2006 | Winston |
| 7,127,360 | B2 | 10/2006 | Gysling |
| 7,139,667 | B2 | 11/2006 | Rothman |
| 7,146,864 | B2 | 12/2006 | Sullivan |
| 7,150,202 | B2 | 12/2006 | Gysling |
| 7,152,003 | B2 | 12/2006 | Loose |
| 7,152,460 | B2 | 12/2006 | Gysling |
| 7,165,464 | B2 | 1/2007 | Gysling |
| 7,171,315 | B2 | 1/2007 | Loose |
| 7,181,955 | B2 | 2/2007 | Gysling |
| 7,197,938 | B2 | 4/2007 | Gysling |
| 7,197,942 | B2 | 4/2007 | Gysling |
| 7,237,440 | B2 | 7/2007 | Gysling |
| 7,245,385 | B2 | 7/2007 | Kersey |
| 7,249,525 | B1 | 7/2007 | Engel |
| 7,253,742 | B2 | 8/2007 | Davis |
| 7,275,421 | B2 | 10/2007 | Gysling |
| 7,295,933 | B2 | 11/2007 | Gysling |
| 7,302,861 | B2 | 12/2007 | Winston |
| 7,308,820 | B2 | 12/2007 | Engel |
| 7,320,252 | B2 | 1/2008 | Jones |
| 7,322,251 | B2 | 1/2008 | Gysling |
| 7,328,113 | B2 | 2/2008 | Rothman |
| 7,328,624 | B2 | 2/2008 | Gysling |
| 7,330,797 | B2 | 2/2008 | Bailey |
| 7,337,075 | B2 | 2/2008 | Gysling |
| 7,340,353 | B2 | 3/2008 | Gysling |
| 7,343,818 | B2 | 3/2008 | Gysling |
| 7,343,820 | B2 | 3/2008 | Gysling |
| 7,359,803 | B2 | 4/2008 | Gysling |
| 7,363,800 | B2 | 4/2008 | Gysling |
| 7,367,239 | B2 | 5/2008 | Engel |
| 7,367,240 | B2 | 5/2008 | Gysling |
| 7,379,828 | B2 | 5/2008 | Loose |
| 7,380,438 | B2 | 6/2008 | Gysling |
| 7,389,187 | B2 | 6/2008 | Kersey |
| 7,389,687 | B2 | 6/2008 | Gysling |
| 7,400,985 | B2 | 7/2008 | Fernald |
| 7,418,877 | B2 | 9/2008 | Gysling |
| 7,426,852 | B1 | 9/2008 | Rothman |
| 7,430,924 | B2 | 10/2008 | Gysling |
| 7,437,946 | B2 | 10/2008 | Gysling |
| 7,440,873 | B2 | 10/2008 | Bailey |
| 7,454,981 | B2 | 11/2008 | Gysling |
| 7,474,966 | B2 | 1/2009 | Fernald |
| 7,480,056 | B2 | 1/2009 | Waagaard |
| 7,503,227 | B2 | 3/2009 | Davis |
| 7,516,024 | B2 | 4/2009 | Gysling |
| 7,526,966 | B2 | 5/2009 | Gysling |
| 7,571,633 | B2 | 8/2009 | Gysling |
| 7,587,948 | B2 | 9/2009 | Gysling |
| 7,596,987 | B2 | 10/2009 | Gysling |
| 7,603,916 | B2 | 10/2009 | Gysling |
| 7,617,716 | B2 | 11/2009 | Gysling |
| 7,623,976 | B2 | 11/2009 | Gysling |
| 7,624,650 | B2 | 12/2009 | Gysling |
| 7,624,651 | B2 | 12/2009 | Fernald |
| 7,644,632 | B2 | 1/2010 | Best |
| 7,657,392 | B2 | 2/2010 | Gysling |
| 7,658,117 | B2 | 2/2010 | Jones |
| 7,672,794 | B2 | 3/2010 | Gysling |
| 7,673,526 | B2 | 3/2010 | Bailey |
| 7,725,270 | B2 | 5/2010 | Davis |
| 7,752,918 | B2 | 7/2010 | Davis |
| 7,793,555 | B2 | 9/2010 | Gysling |
| 7,880,133 | B2 | 2/2011 | Johansen |
| 7,881,884 | B2 | 2/2011 | Perry |
| 7,882,750 | B2 | 2/2011 | Davis |
| 7,950,451 | B2 | 5/2011 | Alberty |
| 7,962,293 | B2 | 6/2011 | Gysling |
| 8,061,186 | B2 | 11/2011 | Gysling |
| 8,109,127 | B2 | 2/2012 | Gysling |
| 8,280,650 | B2 | 10/2012 | Perry |
| 8,336,393 | B2 | 12/2012 | Davis |
| 8,346,491 | B2 | 1/2013 | Loose |

(56) References Cited

U.S. PATENT DOCUMENTS

| | | | | |
|---|---|---|---|---|
| 8,364,421 | B2 | 1/2013 | Chen | |
| 8,375,798 | B2 | 2/2013 | Anderson | |
| 2004/0015295 | A1 | 1/2004 | Bratvedt | |
| 2008/0115049 | A1 | 5/2008 | Tolle | |
| 2009/0007650 | A1 * | 1/2009 | Hayworth | E21B 47/10 73/152.29 |
| 2009/0216341 | A1 | 8/2009 | Enkerud | |
| 2011/0063292 | A1 | 3/2011 | Holl | |
| 2011/0082676 | A1 | 4/2011 | Bratvedt | |

* cited by examiner

ALTERNATIVE GAUGING SYSTEM FOR PRODUCTION WELL TESTING AND RELATED METHODS

BACKGROUND

In the petroleum industry, a production well test is the execution of a set of planned data acquisition activities to broaden the knowledge and understanding of well productivity, fluid properties (e.g., hydrocarbon mix) and characteristics of the underground reservoir where the hydrocarbons reside. Cold, low rate, slug flow heavy oil wells have traditionally been production tested using batch separation process based in-line metering systems. These systems have large footprints; require regular maintenance and some of the batch process systems are open systems, which are typically subject to additional environmental regulations.

What is needed is a closed loop automatic well test (AWT) system and process having low operational and maintenance costs with improved gauging precision and accuracy over the existing batch separation process based AWTs.

SUMMARY

In one aspect, embodiments disclosed herein relate to a method for measuring a well fluid parameter including diverting a fluid through a first loop comprising one or more fluid parameter measurement components, determining a gross flow rate of the fluid, recirculating the fluid through a second loop upon determining the gross flow rate is below a threshold amount, and measuring the fluid parameter upon the gross flow rate reaching or exceeding the threshold amount.

In other aspects, embodiments disclosed herein relate to a system connected to a production well for measuring a well fluid parameter, the system including a first fluid circulation loop comprising one or more fluid parameter measurement components for measuring the well fluid parameter, a second fluid circulation loop comprising a pump and in fluid communication with the first fluid circulation loop, and a control valve disposed in the first fluid circulation loop downstream from the second fluid circulation loop, wherein the well fluid is recirculated at an increased flow rate through the second fluid circulation loop upon determining a gross flow rate of the well fluids is below a threshold amount, and wherein the fluid parameter is measured after the well fluid is recirculated through the second fluid circulation loop.

BRIEF DESCRIPTION OF THE DRAWINGS

The invention is illustrated in the accompanying drawings wherein.

DETAILED DESCRIPTION

Figure 1:
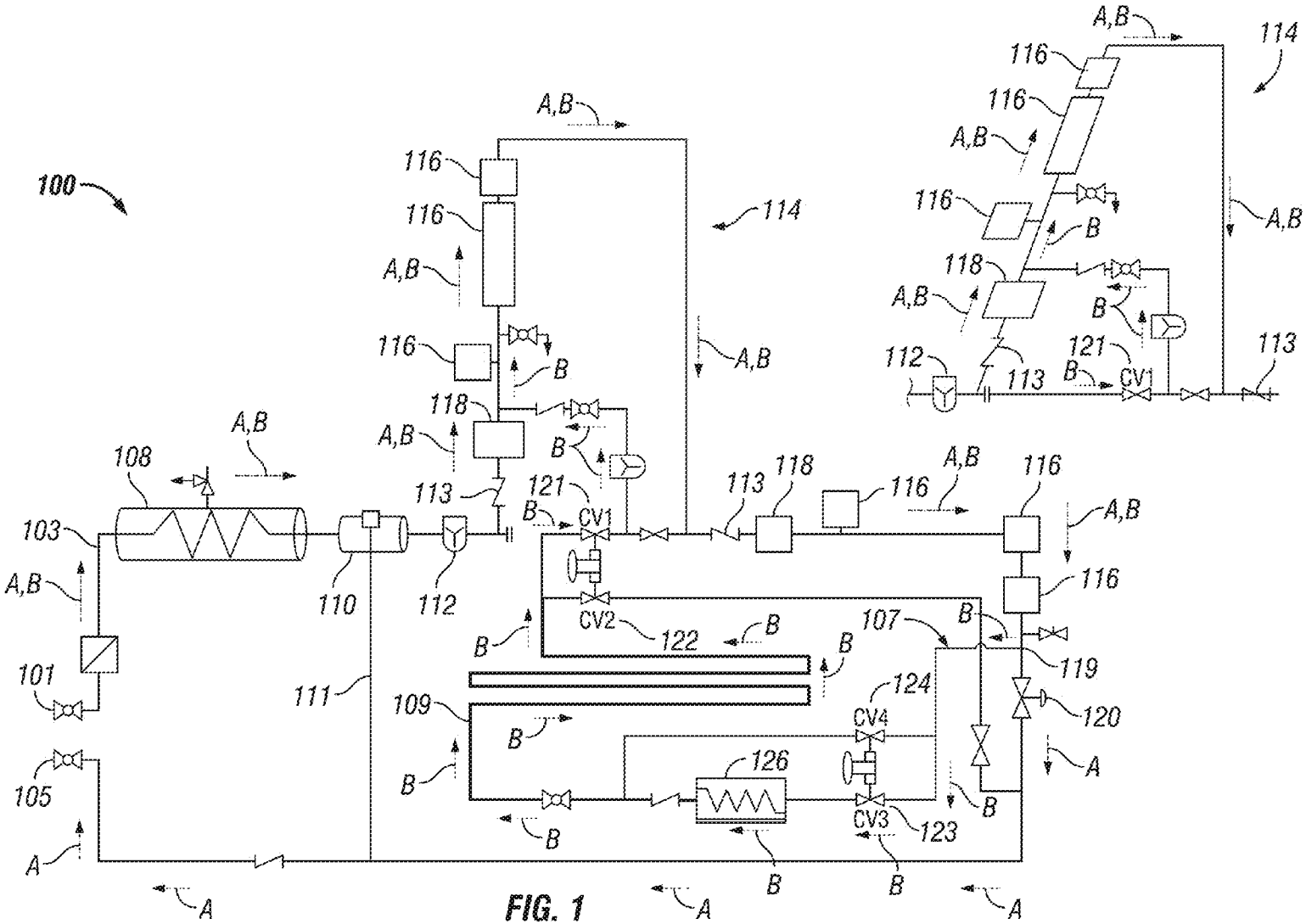
FIG. 1 illustrates an embodiment of a schematic of the alternative gauging system.

The aspects, features, and advantages of the invention mentioned above are described in more detail by reference to the drawings, wherein like reference numerals represent like elements.

An alternative gauging system (AGS) for in-line metering of a production well is disclosed. The AGS may be configured such that it is mounted on a trailer or skid for a portable gauging solution (e.g., a test trailer), or it may be permanently installed at a production well site. The AGS may be coupled to the production well as a standalone component, coupled downstream of an integrated or stand-alone production header as an automatic well test system, or coupled upstream of existing gauging systems or automatic well testers (AWTs), for example in series with other AWTs for proving and performance verification needs. A fluid, such as a production fluid or fluids or other well fluid may be diverted from the production well (or a test-line of the production well) through the AGS by one or more valves, which may be manually or automatically operated.

The AGS may include a first loop, and a second loop incorporated with or within the first loop. The combination of the first and second loop provides improved precision and accuracy in determining water-cut/water hold-up percentage, physical and bulk fluid properties and other fluid parameters of the well fluid. The first loop comprises a continuous closed line having an inlet at a first end and an outlet at a second end. The inlet and outlet may be connected or coupled to a production well, or a test line connected to a production well, at substantially the same location. The first loop may comprise a generally cylindrical continuous line having a variety of diameters, such as at least about 1 inch, or at least 1½ inches, or at least about 2 inches, up to about 3 inches, or up to 4 inches, or up to 5 inches, or greater. Also, the first loop may have a constant diameter throughout, or alternatively, the first loop may have a variable diameter.

The first loop may comprise a variety of components for conditioning the well fluid flowing through the line. For example, the first loop may comprise, but is not limited to, one or more basket strainers, one or more heat exchangers or heating elements, one or more air and gas eliminators or removal devices, and one or more mixers. These components may be referred to as "pre-conditioning" equipment. Other pre-conditioning equipment may also be included. The pre-conditioning equipment may be arranged in the first loop in any number of manners or arrangements or orders. For example, in one embodiment, the basket strainer is located downstream from the inlet, the heat exchanger is located downstream from the basket strainer, the air and gas eliminator is located downstream from the heat exchanger, and the mixer is located downstream from the air and gas eliminator.

The first loop further comprises a measurement loop including one or more fluid parameter meters (e.g., flow meters, water-cut meters, and any number of other fluid parameter measurement meters). The measurement loop is located in the first loop downstream from the pre-conditioning equipment. The first loop may further comprise additional fluid parameter meters, such as flow meters and water-cut meters located downstream from the measurement loop. Still further, the first loop further comprises one or more pressure control valves configured to restrict or prevent gas or vapor flashing at the point of measurement by applying back pressure and to create a homogenized fluid flow through the first loop.

A second loop is integrated with the first loop. The second loop may be referred to as a "recirculation loop" because the second loop redirects fluid from a first location in the first loop and routes the fluid to a second location upstream from the first location in the first loop, such that the total fluid is "recirculated" in the first loop. For example, the first location in the first loop may be downstream from the measurement loop, and the second location may be upstream of the measurement loop. The second loop may comprise a generally cylindrical continuous line having a variety of diameters, such as at least about 1 inch, or at least 1½ inches, or at least about 2 inches, up to about 3 inches, or up to 4 inches, or up to 5 inches, or greater. Also, the second loop may have a constant diameter throughout, or alternatively, the second loop may have a variable diameter.

The second loop comprises a variable frequency drive motor and progressive cavity/screw pump disposed in the line used to recirculate fluid through the second loop back to the first loop at specified velocities. Further, a variable frequency drive controller may be operated for controlling the motor of the pump, and thereby the recirculation flow rate. The second loop further comprises multiple control valves disposed in the line at various locations in the second loop, which are opened and closed in various configurations to provide a number of flow paths through the second loop, as determined by an operator.

Methods of measuring one or more fluid parameters of a well fluid are also disclosed, and may include an initial purging process of fluids from the first and second loops, followed by a measuring process of fluids circulating through the first and second loops. Fluids are diverted into the inlet of the first loop where the fluids are pre-conditioned by the pre-conditioning equipment. Pre-conditioning the test fluids may include heating the incoming fluids. For example, incoming fluids may be heated to at least about 100° F., 110° F., 120° F., or 130° F. and up to at least about 150° F., 160° F., 170° F., 180° F., or 200° F. Pre-conditioning the test fluids may also include injecting one or more chemicals into the test fluids. For example, emulsion breakers (EB), reverse emulsion breakers (REB) or inhibitors may be injected into the test fluids. One or more ports may be available for chemical injection, in one example, downstream of the heat exchanger. Chemicals may be added to help prevent frequent plugging of the strainer and to improve the effectiveness of the air-eliminator. Still further, pre-conditioning the test fluids may also include eliminating any free gas and vapor using the air eliminator.

Prior to beginning the purging process, the actual flow rate of fluid from the production well flowing through the AGS is determined and used to calculate a "purge time" for removing all previous well test fluids from the first and second loops and to obtain a representative well fluid sample. To determine the actual flow rate, a "gross rate" determination is performed in which a flow meter is used to calculate the gross volumetric flow rate, based on direct measurements of mass flow rate and density of the well fluid. In certain embodiments, a 25 minute period may be used in the gross rate determination; however other time periods may also be used. For example, in other embodiments at least a 5 minute, or 10 minute, or 15 minute period may be used, and up to a 30 minute, 40 minute, or 60 minute period. The gross rate determination time required is a user input parameter and may be customized for different field conditions.

A required "purge time" for the purging process is then calculated according to the determined gross rate. The required purge time may be calculated based on the volume of fluid present at a given time in lines of the first and second loops of the AGS, which must be displaced and removed. The time required to determine the gross rate may also be counted towards or included in the total purge time. During the purging process, a specific flow path through the first and second loops is provided by opening and closing various control valves. For example, one or more control valves may be opened, either fully or partially, and one or more control valves may be fully closed, which thereby routes or reroutes the fluid path through the first and second loops.

During the measuring cycle, fluid parameters of the well fluid such as water percentage and others are measured and analyzed. A determination is first made as to whether fluid velocity is adequate for precise and accurate measurements desired by the AGS. Accurate inline measurements require substantially homogenized mix of fluids. For example, for a 2 inch diameter horizontal line, homogeneity of a fluid may be achieved at approximately 2.0 ft./sec. If fluid velocity in the first loop is inadequate or below a threshold value, recirculation of the fluids through the second loop (or recirculation loop) using a pump may be required (e.g., a spin cycle through the recirculation loop to create homogeneity in the fluid). In certain embodiments, the threshold for turning the pump "ON" and recirculating is a gross volumetric flow rate less than approximately 750 barrels of fluid per day ("BFPD"), which may correspond to approximately 2.2 feet per second (ft/sec) in a 2 inch line. Other threshold fluid velocities may also be selected for other diameters. The well fluid bypasses the second loop in response to determining that the fluid velocity in the first loop is at or above the threshold value.

For wells with greater than approximately 750 BPPD rates (no recirculation required), a flow-weighted water-cut value may be calculated and averaged over a period of time for statistical convergence. For wells with less than 750 BFPD gross rates, the pump may be turned "ON" and average water-cut values may be determined after reaching steady state (or approximately 5-10 minutes).

During the measuring process, a specific flow path through the first and second loops is provided by opening and closing various control valves. For example, one or more control valves may be opened, either fully or partially, and one or more control valves may be fully closed, which thereby routes or reroutes the fluid along various paths through the first and second loops. Further, the pump is turned on and operated with variable frequency drive controller. In one or more embodiments, a desired pump rate set point is approximately 1500 barrels per day (BPD), which is equivalent to a volumetric flow rate of approximately 33 gallons per minute (GPM). However, other pump rate set points may be used, such as at least about 750 BPD, 1000 BPD, and 1250 BPD, up to about 1750 BPD, 2000 BPD, and 2500 BPD (with equivalent volumetric flow rates).

As the pump circulates, well fluids from the production well may continue to flow into the first loop of the AGS, thereby increasing pressure in the first and second loops, particularly the second loop. A control valve in the first loop may be operated (e.g., opened and closed) to gradually decrease pressure in the first and second loops as required. A V-ball valve may be used for fine pressure control adjustments. Once a statistical steady state is reached in the first and second loops, a water-cut/water hold-up percentage may be determined using the measurement loop of the AGS, including the water-cut meters and flowmeters and others. In certain embodiments, individual gross rate and net oil rates may be determined within ±10% net oil error at 90% or less water-cut, and ±15% net oil error at greater than 90% water-cut. In other embodiments, individual gross rate and net oil rates may be determined within ±5% net oil error at 90% or less water-cut, and ±10% net oil error at greater than 90% water-cut.

The AGS further comprises certain instrumentation, such as a programmable logic controller (PLC) and a high speed data acquisition system. The PLC may be any digital computer used for automation of electromechanical processes, and designed for multiple inputs and output arrangements, extended temperature ranges, immunity to electrical noise, and resistance to vibration and impact. The programs to control operation of the AGS may be stored in battery-backed-up or non-volatile memory. For example, the AGS may comprise a PLC cabinet utilizing a radio interface that may control and monitor the AGS. One or more water-cut meters or other fluid parameter meters may provide water-cut percentage, temperature, salinity values, and other fluid properties to the PLC. Further, one or more pressure transmitters may provide real-time pressure data to the PLC, which may be used to control the back pressure control valve that maintains a minimum pressure on the AGS. Still further, one or more flow meters may provide gross flow rate data to the PLC. The AGS may further comprise one or more human machine interface (HMI) screens depicting AGS measurement values, instrumentation, and process and instrumentation alarms and shutdowns. For example, analog or digital pressure gauges may be installed in multiple locations to allow for operator monitoring at the site.

Data recovered from the AGS may be retrieved and trended using Wonderware's ActiveFactory™ software, which is commercially available from Invensys Systems, Inc., or any other 3rd party data retrieval and trending tool, as well as, LOWIS™ (Life of Well Information Software), which is commercially available from Weatherford International Ltd., for tracking and evaluation of production well test data by production and reservoir engineers. This data may be compared with traditional AWT gauge data based on average cut during the duration of the test, as well as, a detailed minute-by-minute and/or second-by-second gauge.

Figure 2:
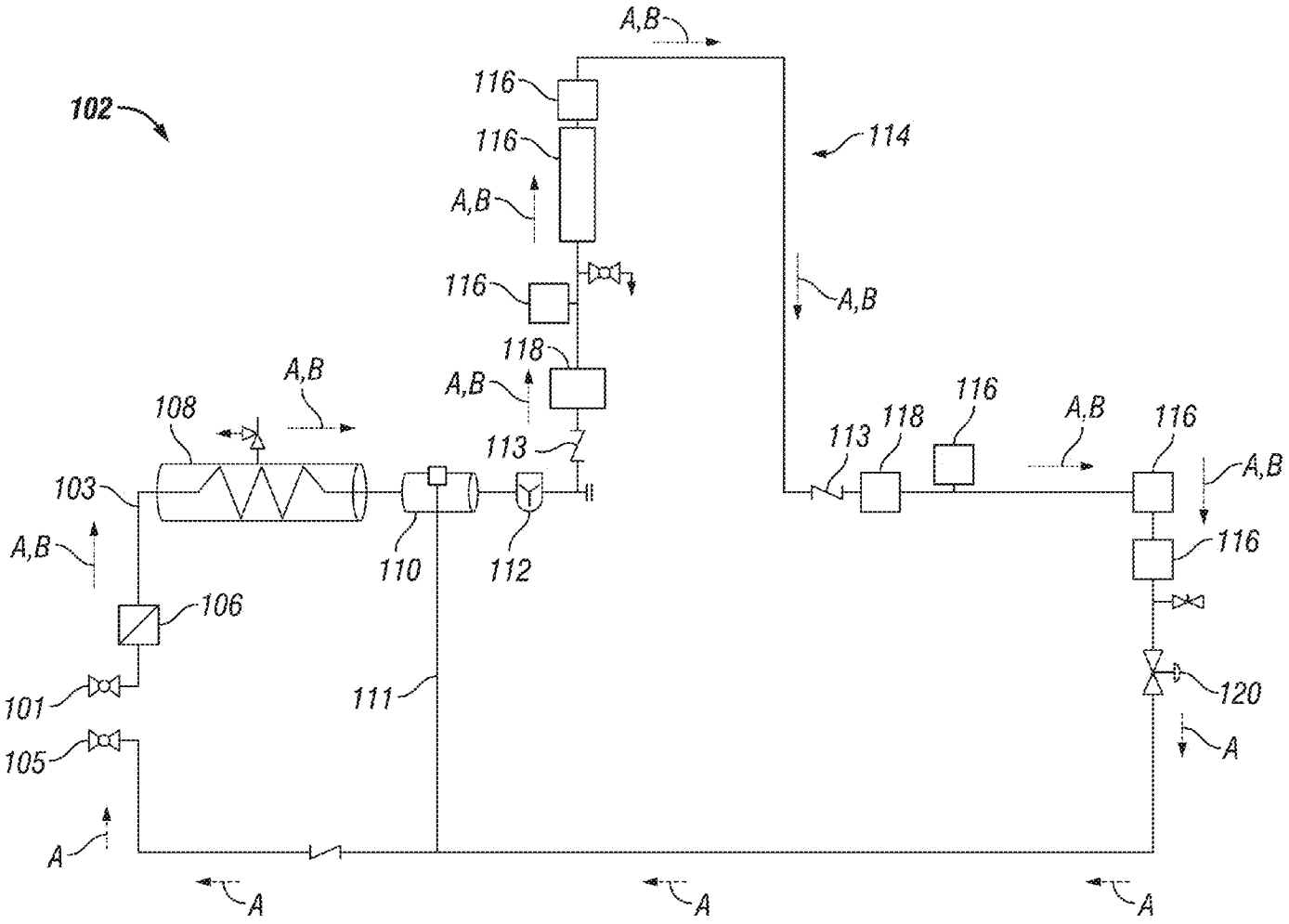
FIG. 2 illustrates an embodiment of the first loop of the alternative gauging system shown in FIG. 1.

FIG. 1 illustrates AGS 100 in accordance with one or more embodiments. The system 100 includes a first loop, or high rate process flow loop 102 and a second loop, or low rate process flow loop 104, better shown in FIGS. 2 and 3, respectively. The first and second loops 102 and 104 may be disposed or installed on a surface or structure, such as a skid or skid frame. In embodiments, the surface may be substantially a horizontal planar surface that sits on the ground at a production well. In embodiments, the surface may be portable with wheels or other transportation means. Referring to FIG. 2, the high rate process flow loop 102 comprises a continuous closed line 103 having an inlet 101 at a first end and an outlet 105 at a second end. The inlet 101 and outlet 105 are connected at substantially the same point on the production tubing, or on a test line of the production well (not shown).

A basket strainer 106, or any strainer or perforated metal sieve used to strain or filter out solid debris, is disposed in the line 103 downstream from the inlet 101. For example, the basket strainer 106 may be a dual-basket strainer to filter out any downhole debris (e.g., stuffing box rubber packing, paint material, fragments from centralizers and rod guides, etc.) that may be carried with the well fluids from the production well. A dual basket design may allow the AGS to remain operational even when one side of the basket strainer is being serviced.

A heat exchanger 108 or heater is disposed in the line 103 downstream from the basket strainer 106. In one or more embodiments, the heat exchanger 108 may be electric. For example, electric heat exchangers having Class I Div II certifications or other applicable certifications and commercially available from Chromalox® Precision Heat and Control headquartered in Pittsburgh, Pa. may be used.

An air eliminator 110 is disposed in the line 103 downstream from the heat exchanger 108. Any air eliminator may be used, for example, a Smith Meter® Model AR Air Eliminator commercially available from FMC Technologies headquartered in Houston, Tex. can be used. The air eliminator 110 may be used for removing any "free" air or gas in the liquid stream of the well fluid in line 103. Free air or gas removed from the liquid stream in line 103 may be removed through gas line 111, where it is returned to the first loop and circulated out through the outlet 105. One or more mixers 112 may also be disposed in line 103, for example downstream from the air eliminator 110.

A measurement loop 114 of the high rate circulation loop 102 comprises a number of various measurement devices, including, but not limited to water-cut meters 116 and flowmeters 118. Flowmeters 118 may comprise any number of configurations. For example, one or more embodiments may use multiphase flowmeters based on speed of sound and acoustics measurement. One or more embodiments may use multiphase flowmeters based on microwave energy absorption. An example of a gas flow meter that can be utilized is a vortex flow meter such as those commercially available from Cole-Parmer headquartered in Vernon Hills, Ill. or Emerson Electric Co. One or more Coriolis meters can also be utilized such as the Micro Motion Coriolis meters manufactured by Emerson Electric Co.

One or more water-cut meters 116 may be used in embodiments. Various types of water-cut meters may be used. For example, an in-line two phase water-cut meter based on infrared absorption and commercially available from Weatherford may be used. Also, a two phase water-cut meter based on microwave energy absorption, and based on differences in dielectric constant/permittivity of oil and water, may be used.

In one or more embodiments, the portion of the line 103 that comprises the measurement loop 114 may be configured to make approximately a 90 degree bend or turn upward in a substantially vertical direction from the substantially horizontal surface on which the first loop is mounted. The portion of the line 103 of the measurement loop 114 may make approximately a 180 degree turn and extend back downward in a substantially vertical direction, to resemble an inverted "U-shape" loop. In alternate embodiments, the measurement loop may extend upward in a diagonal manner. In yet other embodiments, the measurement loop may be horizontal. The one or more water-cut meters 116 and flowmeters 118 may be disposed in the substantially vertical portion of the line 103. Additional water-cut meters 116 and flowmeters 118 may be disposed in the line 103 downstream of the measurement loop 114.

Figure 3:
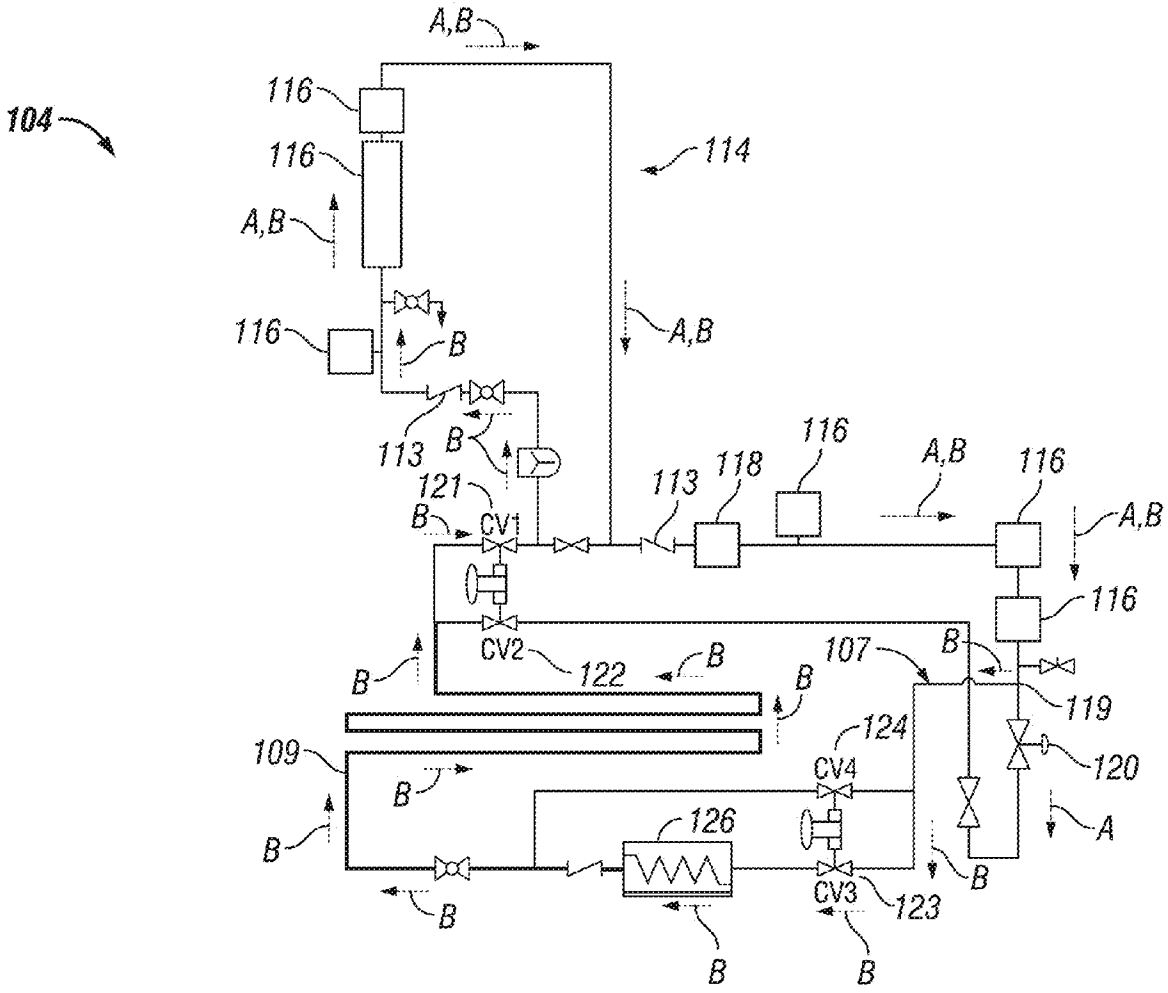
FIG. 3 illustrates an embodiment of the second loop of the alternative gauging system shown in FIG. 1.

As illustrated in FIGS. 1-3, one or more fluid parameter measurement components may comprise one or more water-cut meters 116 and one or more flowmeters 118, and a check valve 113 may be disposed in the first fluid circulation loop (e.g., the first loop 102) upstream of the one or more water-cut meters 116 and the one or more flowmeters 118. Furthermore, one or more fluid parameter measurement components may comprise one or more water-cut meters 116 and one or more flowmeters 118, and a check valve 113 may be disposed in the second fluid circulation loop (e.g., the second loop 104) upstream of the one or more water-cut meters 116 and the one or more flowmeters 118.

A pressure control valve 120 is disposed in the line 103 downstream from the measurement loop 114 which is operable to allow or restrict and prevent flow through line 103. The control valve 120 may have a variable diameter orifice that can be partially closed to merely restrict fluid flow there through and thereby apply back pressure upstream in the line 103. The control valve 120 may also be fully closed to stop flow in the line 103 of the first loop 102.

Referring to FIG. 3, the low rate process flow loop 104 is attached with the high rate process flow loop 102 at a junction 119 upstream from the pressure control valve 120. The low rate process flow loop 104 comprises a line 107 having a first diameter. The low rate process flow loop 104 may also comprise a portion 109 of line 107 having a second diameter.

A variable frequency drive (VFD) pump 126 is disposed in the line 107 of the second loop 104 to recirculate fluid through the second loop 104. For example, a single-stage L-Frame Moyno progressive cavity positive displacement pump may be used to create recirculation in the low rate process flow loop 104 at required velocities. A 7½ HP motor with a VFD controller may be provided for flow rate control of fluid through the second loop 104. The VFD controller may be included in the AGS for controlling the motor RPM/recirculation loop flow rate by modulating the frequency of the current providing power to the motor. The VFD may shut down the motor on high-high or low-low discharge pressure or high amperage draw and provide flexibility to increase or decrease flow velocity as desired by the operator.

Multiple control valves 121, 122, 123 and 124 are disposed in the lines 105 & 107 at various locations in the low rate process flow loop 104. The control valves 121, 122, 123 and 124 may be opened and closed in various configurations to provide a number of flow paths through the second loop 104, as determined by an operator, and which will be explained in more detail below.

As shown in FIGS. 1-3, well fluid is diverted into the first loop of the AGS (see arrows 'AB') from the production well until the fluids reaches the second loop, wherein low rate fluids may be recirculated (see arrows 'B') back through the second loop. The recirculated fluid is pumped at an increased flow rate through the second loop and rejoins well fluids from the production well upstream of the measurement loop. Once the fluids have been recirculated, valve 120 can be opened allowing fluids to exit the first loop via outlet 105 (see arrows 'A').

Figure 4:
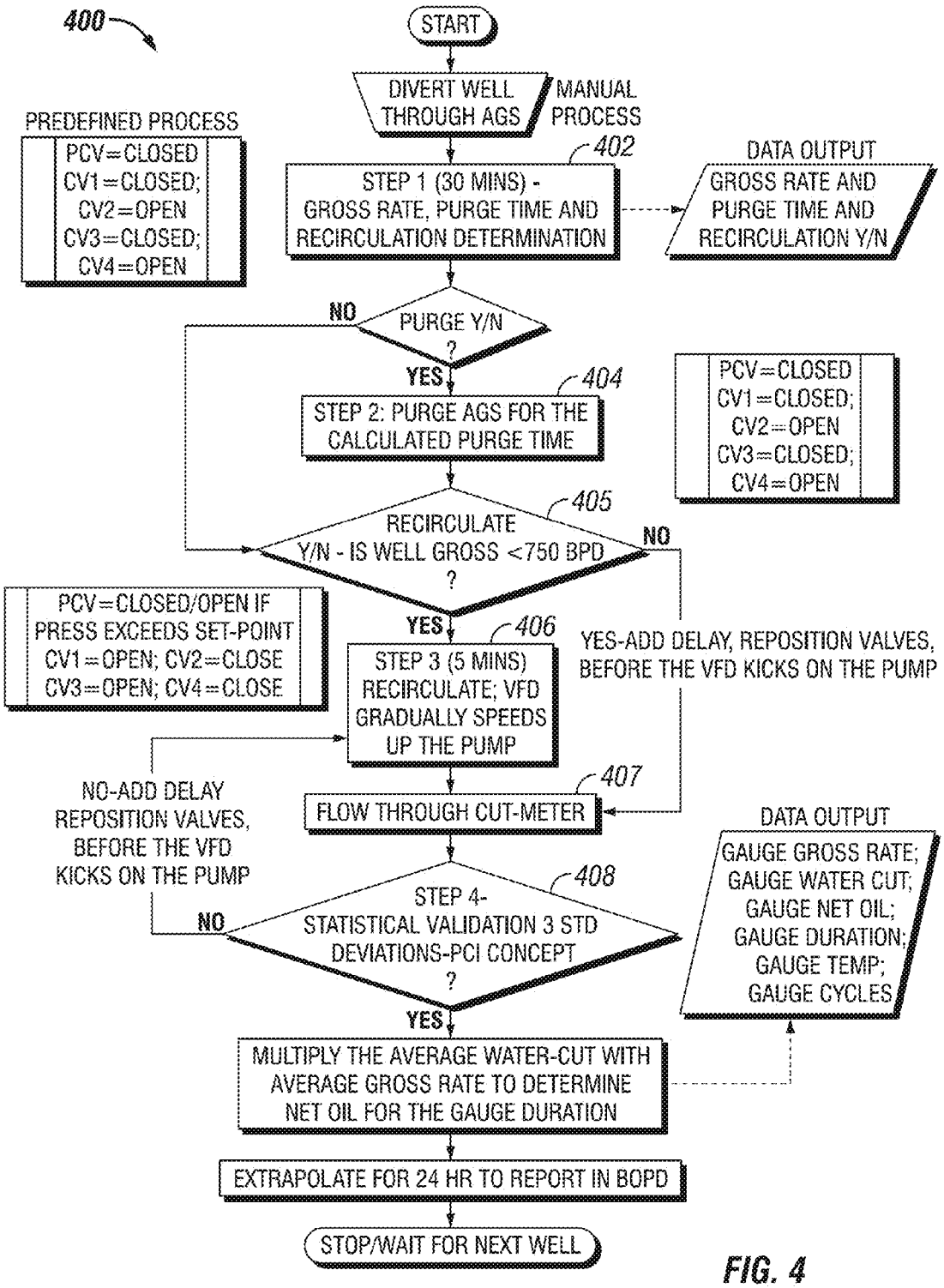
FIG. 4 illustrates an embodiment of an operational flow chart of the alternative gauging system.

Referring now to FIGS. 1-3 and 4, methods of testing and measuring various parameters of well fluids using the AGS are now disclosed. FIG. 4 illustrates an embodiment of an operational flow chart 400 of the AGS. Fluid is diverted from the production well and into the first loop (see arrows AB) of the AGS. Initially, at step 402, the actual flow rate of the well is determined and used to calculate a "purge time" for removing all previous well test fluids and to obtain a representative well fluid sample. To determine the actual flow rate, a "gross rate" determination is performed in which one or more flowmeters 118 are used to calculate the gross volumetric rate, based on direct measurements of mass rate and density of the test fluid. In certain embodiments, a 25 minute period may be used in the gross rate determination; however, other time periods may also be used. The gross rate determination time period is a user input parameter and may be customized for different field conditions.

Once the gross rate of the well is determined and if a purge is to be performed, an appropriate "purge time" can be calculated. For example, the appropriate purge time can be calculated based on the volume of fluid in lines 103, 105, 107 of the AGS, which must be displaced and removed from the AGS. The time required to determine the gross rate may be counted towards the purge time. At step 404, during the "purge cycle," a certain flow path through the AGS, particularly the second loop 104, is provided by opening and closing various control valves. In reference to FIG. 3, the flow path and valve positions through the second loop 104 during the purge cycle are as follows: Pressure control valve (PCV) 120 is fully closed; control valve 123 is fully closed; control valve 124 is fully open; control valve 122 is fully open; and control valve 121 is fully closed.

After the purge cycle, at step 405, a "water-cut/water hold-up determination cycle" is performed where fluid parameters such as water percentage are measured and analyzed. For precise and accurate measurements desired by the AGS however, a determination is made as to whether the gross fluid flow rate is adequate for such measurement. If fluid gross fluid flow rate is inadequate or below a threshold value, at step 406, the fluids are recirculated through the low rate process flow loop 104 using the pump (see arrows 'B'). The fluid bypasses the second loop 104 in response to determining that the gross fluid flow rate in the first loop 102 is at or above the threshold value. In certain embodiments, the threshold for recirculation in step 405 is wells having gross flow rates less than 750 barrels of fluid per day ("BFPD"). This threshold may be customized and varied according to the field conditions. A 750 BFPD corresponds to approximately 2.2 feet per second (ft/sec) m a 2 inch line. Accurate inline measurements rely on a homogenized mix of fluids, which for a horizontal 15 line occurs at approximately 2.0 ft/sec.

To recirculate the fluid through the low rate flow process loop (see arrows B), control valve 120 is closed to divert fluids to low rate process flow loop 104. The flow path and valve positions during recirculation are as follows: control valve 122 is fully closed and control valve 121 is fully opened (which closes the purge loop); control valve 124 is fully closed and control valve 123 is fully opened (which closes the pump loop). The pump 126 is turned on with VFD speed control. In embodiments, the VFD gradually increases the speed of the pump up to a desired set point. For example, in one or more embodiments, the desired set point is approximately 1500 BPD (or 33 GPM).

As the pump circulates, the well continues to flow into the AGS system, pressuring up the recirculation loop. The control valve 120 may be operated to gradually release some of this pressure as required. A V-ball valve (not shown) may be used for fine pressure control. The pressure control valve 120 is throttled by flow control with pressure override to maintain the required fluid velocity of 2.2 ft/sec. Once a statistical steady state is reached, a water-cut percentage may be determined.

At step 407, for wells with greater than 750 BFPD rates (no recirculation required), a flow-weighted water-cut value may be calculated and averaged over a time for statistical convergence. For wells with less than 750 BFPD gross rates, fluids can be recirculated and average water-cut may be determined after reaching steady state (or approximately 5-10 minutes) (see step 408).

The claimed subject matter is not to be limited in scope by the specific embodiments described herein. Indeed, various modifications of one or more embodiments disclosed herein in addition to those described herein will become apparent to those skilled in the art from the foregoing descriptions. Such modifications are intended to fall within the scope of the appended claims.

As used in this specification and the following claims, the terms "comprise" (as well as forms, derivatives, or variations thereof, such as "comprising" and "comprises") and "include" (as well as forms, derivatives, or variations thereof, such as "including" and "includes") are inclusive (i.e., open-ended) and do not exclude additional elements or steps. Accordingly, these terms are intended to not only cover the recited element(s) or step(s), but may also include other elements or steps not expressly recited. Furthermore, as used herein, the use of the terms "a" or "an" when used in conjunction with an element may mean "one," but it is also consistent with the meaning of "one or more," "at least one," and "one or more than one." Therefore, an element preceded by "a" or "an" does not, without more constraints, preclude the existence of additional identical elements.

The use of the term "about" applies to all numeric values, whether or not explicitly indicated. This term generally refers to a range of numbers that one of ordinary skill in the art would consider as a reasonable amount of deviation to the recited numeric values (i.e., having the equivalent function or result). For example, this term can be construed as including a deviation of ±10 percent of the given numeric value provided such a deviation does not alter the end function or result of the value. Therefore, a value of about 1% can be construed to be a range from 0.9% to 1.1%.

What is claimed:

1. A system in fluid communication with a production well for measuring a well fluid parameter, the system comprising:

a first fluid circulation loop comprising one or more fluid parameter measurement components for measuring the fluid parameter;

a second fluid circulation loop comprising a pump, and in fluid communication with the first fluid circulation loop; and a control valve disposed in the first fluid circulation loop downstream from the second fluid circulation loop, wherein the well fluid is circulated through the second fluid circulation loop in response to determining that a gross flow rate of the well fluid in the first fluid circulation loop is below a threshold amount, and wherein the fluid parameter is measured in the first fluid circulation loop after the well fluid is circulated through the second fluid circulation loop.

2. The system of claim 1, further comprising well fluid preconditioning equipment disposed in the first fluid circulation loop upstream from the one or more fluid parameter measurement components.

3. The system of claim 2, wherein the well fluid preconditioning equipment comprises one or more basket strainers.

4. The system of claim 1, further comprising a variable frequency drive controller coupled with the pump.

5. The system of claim 1, further comprising one or more control valves in the second fluid circulation loop configurable to route the well fluid along multiple fluid paths therethrough.

6. The system of claim 1, wherein the one or more fluid parameter measurement components comprise one or more water-cut meters.

7. The system of claim 1, wherein the one or more fluid parameter measurement components comprise one or more flowmeters.

8. The system of claim 1, wherein the control valve disposed in the first circulation loop maintains the pressure of the well fluid in the second fluid circulation loop according to a predetermined pressure set-point.

9. The system of claim 1, wherein the threshold amount is a gross flow rate of approximately 750 barrels of fluid per day.

10. The system of claim 1, wherein the well fluid bypasses the second fluid circulation loop in response to determining that the gross flow rate in the first fluid circulation loop is at or above the threshold amount.

11. The system of claim 1, wherein the one or more fluid parameter measurement components comprise one or more water-cut meters and one or more flowmeters, further comprising a check valve disposed in the first fluid circulation loop upstream of the one or more water-cut meters and the one or more flowmeters.

12. The system of claim 1, wherein the one or more fluid parameter measurement components comprise one or more water-cut meters and one or more flowmeters, further comprising a check valve disposed in the second fluid circulation loop upstream of the one or more water-cut meters and the one or more flowmeters.

13. The system of claim 1, wherein a measurement loop of the first fluid circulation loop resembles an inverted U-shape loop.

14. The system of claim 1, wherein a measurement loop of the first fluid circulation loop extends upward in a diagonal manner.

15. The system of claim 1, wherein a measurement loop of the first fluid circulation loop comprises a horizontal portion.

16. The system of claim 2, wherein the well fluid preconditioning equipment comprises one or more heat exchangers or heating elements.

17. The system of claim 2, wherein the well fluid preconditioning equipment comprises one or more air and gas eliminators or removal devices.

18. The system of claim 2, wherein the well fluid preconditioning equipment comprises one or more mixers.

19. The system of claim 1, wherein the well fluid is circulated through the first fluid circulation loop before the well fluid is circulated through the second fluid circulation loop, and wherein chemicals are injected into the well fluid.

20. The system of claim 2, wherein the well fluid preconditioning equipment disposed in the first fluid circulation loop is utilized to heat the well fluid that is circulated through the first fluid circulation loop before the well fluid is circulated through the second fluid circulation loop, and wherein the well fluid is heated to between approximately 130° F. and 150° F., at least about 100° F., at least about 110° F., at least about 120° F., at least about 130° F., up to at least about 150° F., up to at least about 160° F., up to at least about 170° F., up to at least about 180° F., or up to at least about 200° F.

21. The system of claim 1, wherein a purge time for removing previous well fluid from the first and second fluid circulation loops is calculated using the gross flow rate that is determined in the first fluid circulation loop.

22. The system of claim 1, wherein the well fluid is circulated in the second fluid circulation loop at a flow rate of approximately 1500 barrels per day, at least about 750 barrels per day, at least about 1000 barrels per day, at least about 1250 barrels per day, up to about 1750 barrels per day, up to about 2000 barrels per day, or up to about 2500 barrels per day.

* * * * *